US007092317B2

(12) United States Patent
Ogasawara

(10) Patent No.: US 7,092,317 B2
(45) Date of Patent: Aug. 15, 2006

(54) CHRONOGRAPH TIMEPIECE

(75) Inventor: Kenji Ogasawara, Chiba (JP)

(73) Assignee: Seiko Instruments Inc., (JP)

( * ) Notice: Subject to any disclaimer, the term of this patent is extended or adjusted under 35 U.S.C. 154(b) by 334 days.

(21) Appl. No.: 10/753,642

(22) Filed: Jan. 8, 2004

(65) Prior Publication Data

US 2004/0156272 A1 Aug. 12, 2004

(51) Int. Cl.
*G04F 8/00* (2006.01)
*G04F 10/00* (2006.01)

(52) U.S. Cl. ..... 368/110; 368/112; 368/113

(58) Field of Classification Search ..... 368/110–113, 368/185, 187, 190
See application file for complete search history.

(56) References Cited

U.S. PATENT DOCUMENTS 4,192,134 A 3/1980 Yoshida ..... 368/80
4,357,693 A 11/1982 Plancon et al. ..... 368/187
4,623,261 A * 11/1986 Muto ..... 368/80
5,113,382 A * 5/1992 Bron ..... 368/106
5,289,452 A * 2/1994 Sakamoto et al. ..... 368/73
5,959,941 A 9/1999 Murakami et al. ..... 368/80
6,570,823 B1 * 5/2003 Gilomen et al. ..... 368/113
RE38,197 E * 7/2003 Sakamoto et al. ..... 368/73
6,597,637 B1 * 7/2003 Wyssbrod ..... 368/110
2002/0064099 A1 * 5/2002 Wyssbrod et al. ..... 368/113

FOREIGN PATENT DOCUMENTS

EP 0502292 9/1992

* cited by examiner

*Primary Examiner*—Vit W. Miska
(74) *Attorney, Agent, or Firm*—Adams & Wilks

(57) ABSTRACT

A chronograph timepiece has a movable crown, a start button operable to start and stop measurement of a time period in a chronograph mode using at least one chronograph hand, and a reset button operable to reset the chronograph hand to a zero position. A control circuit controls operation of the start button and the reset button in a plurality of reset modes to return the chronograph hand to the zero position in accordance with whether the reset button has already been operated when the crown is operable from one position to another position.

20 Claims, 5 Drawing Sheets

CHRONOGRAPH TIMEPIECE

BACKGROUND OF THE INVENTION

1. Field of the Invention

The present invention relates to a chronograph timepiece having a chronograph function.

2. Description of the Prior Art

There has conventionally been used a chronograph timepiece having a time hand for indicating current time and a chronograph hand for indicating a measured time interval (for example, a chronograph 1/10 second hand for indicating by a 1/10 second unit, a chronograph second hand for indicating by 1 second unit, a chronograph minute hand for indicating by 1 minute unit, and a chronograph second/minute cooperation hand for cooperatively moving the second hand and the minute hand). The chronograph timepiece is provided with a reset function for resetting a chronograph hand to return to a zero position after finishing measurement or the like.

For example, according to a chronograph timepiece described in JP-A-2002-82183, a reset mode for resetting a chronograph hand can be brought about by pulling a crown. In the reset mode, a chronograph hand for resetting is selected by operating a start button and the selected chronograph hand is reset to return to a zero position by operating a reset button.

Further, according to a chronograph timepiece described in JP-A-2002-207089, although operation of a crown is not needed, a reset mode for resetting a chronograph hand can be brought about by simultaneously operating to depress a start button and a reset button. According to the reset mode, there is constructed a constitution in which a chronograph hand for resetting is selected by operating a start button and the selected chronograph hand is reset to return to a zero position by operating a reset button.

However, in either of JP-A-2002-82183 and JP-A-2002-207089, mentioned above, a consideration is not given to a rotational direction (regular or reverse rotation) in returning the chronograph hand to the zero position and even when the chronograph hand is disposed at any position, the chronograph hand is rotated in one direction to return to the zero position.

Therefore, there poses a problem that a time period of returning the chronograph hand to the zero position is extremely prolonged depending on a position of stopping the chronograph hand and a direction of rotating the chronograph hand to the zero position in resetting the chronograph hand.

Further, according to the chronograph timepiece described in JP-A-2002-82183, there is the problem that in order to indicate the selected chronograph hand, the selected chronograph hand is made to carry out a special movement, thereby complicating the construction of the circuit.

Further, according to the chronograph timepiece described in JP-A-2002-207089, there is a concern of bringing about erroneous operation in counting operation or the like in shifting to the chronograph hand reset mode.

It is an object of the invention to enable the return to a chronograph hand swiftly to a zero position even when the chronograph hand is disposed at any position in a chronograph hand reset mode.

Further, it is another object of the invention to prevent erroneous operation from being brought about in a counting operation or the like in shifting to a chronograph hand reset mode.

Further, it is another object of the invention to enable the selection of a chronograph hand to reset using a chronograph timepiece having a simple construction.

SUMMARY OF THE INVENTION

According to the invention, there is provided a chronograph timepiece including a crown, a start button for starting and stopping to measure a time period, a reset button for returning a chronograph hand to a zero position, and controlling means for shifting a function of resetting the start button and the reset button in resetting the chronograph hand to a plurality of reset modes having different functions for resetting the start button and the reset button in accordance with whether the reset button has already been operated when the crown is operated. The controlling means shifts the function for resetting the start button and the reset button in resetting the chronograph hand to the plurality of reset modes having the different functions for resetting the start button and the reset button in accordance with whether the reset button has already been operated when the crown is operated.

Here, it may be constituted that the controlling means corresponds the chronograph hand and a rotational direction in resetting the chronograph hand to the start button and the reset button in the reset modes.

Further, it may be constituted that the chronograph timepiece includes a chronograph 1/10 second hand and a chronograph second/minute cooperation hand and the controlling means sets a function of resetting to regularly rotate the chronograph 1/10 second hand to the start button and sets a function of resetting to regularly rotate the chronograph second/minute cooperation hand to the reset button in a case in which the reset button has not been operated yet when the crown is operated.

Further, it may be constituted that the chronograph timepiece includes a chronograph second/minute cooperation hand and the controlling means sets a function of resetting to reversely rotate the chronograph second/minute cooperation hand to the start button and sets a function of resetting to regularly rotate the chronograph second/minute cooperation hand to the reset button in a case in which the reset button has already been operated when the crown is operated.

Further, it may be constituted that the chronograph timepiece includes a chronograph 1/10 second hand and a chronograph second hand and the controlling means sets a function of resetting to regularly rotate the chronograph 1/10 second hand to the start button and sets a function of resetting to regularly rotate the chronograph second hand to the reset button in a case in which the reset button has not been operated yet when the crown is operated.

Further, it may be constituted that the chronograph timepiece includes a chronograph minute hand and the controlling means sets a function of resetting to regularly rotate the chronograph minute hand to the start button and sets a function of resetting to reversely rotate the chronograph minute hand to the reset button in a case in which the reset button has already been operated when the crown is operated.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
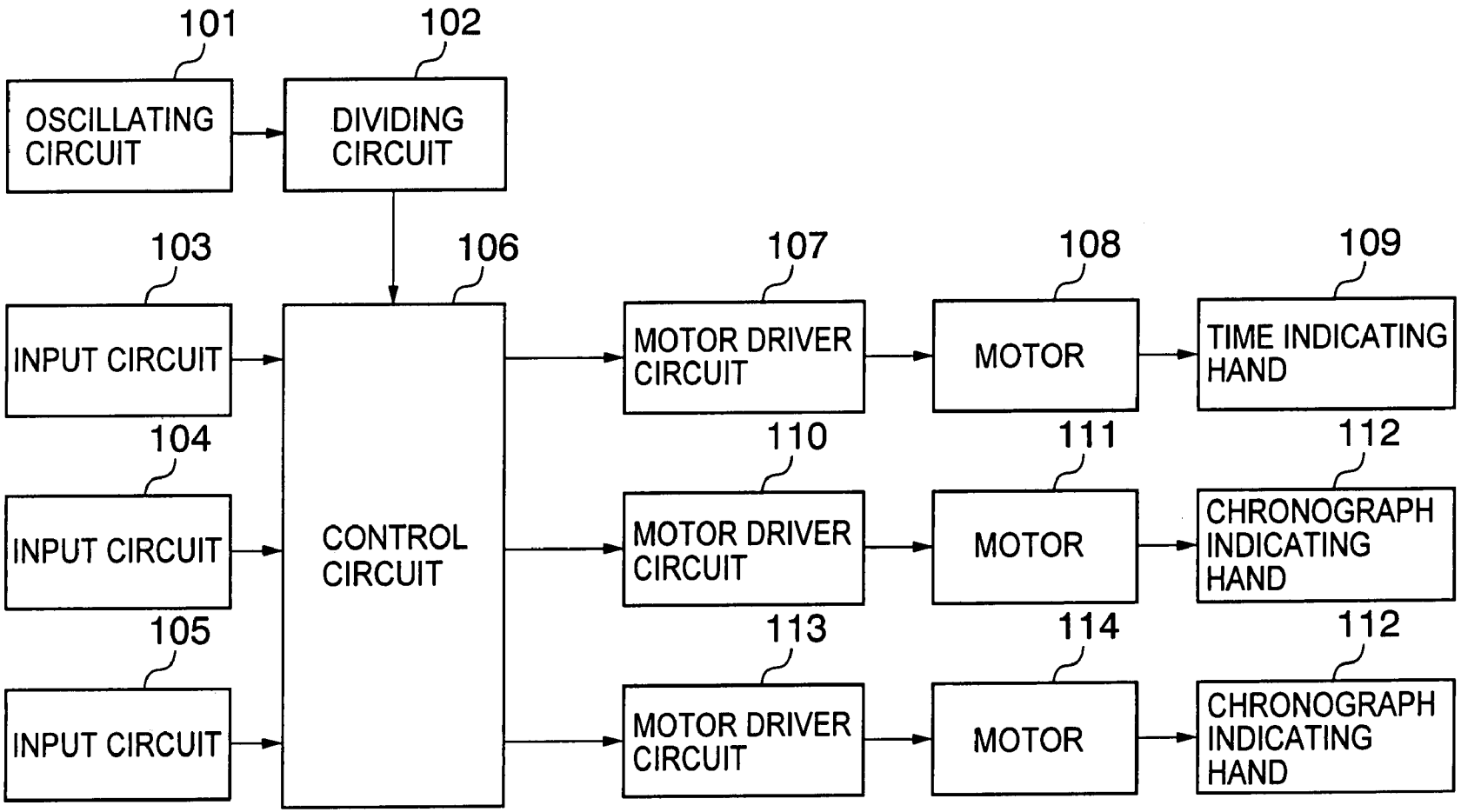
FIG. 1 is a block diagram of a chronograph timepiece according to a first embodiment of the invention.

FIG. 1 is a block diagram of a chronograph timepiece according to a first embodiment of the invention showing an example of an analog/chronograph electronic timepiece having a time hand for indicating current time, a chronograph 1/10 second hand for indicating a measured time period by a 1/10 second unit and a chronograph second/minute cooperation hand for rotating a second hand and a minute hand cooperatively for indicating the measured time period.

In FIG. 1, a chronograph timepiece includes an oscillating circuit 101 for generating a reference signal, a dividing circuit 102 for generating a counting reference signal for counting time by dividing the reference signal, a first input circuit 103 for outputting a time measurement start signal or a time measurement stop signal in accordance with operation of a first button (start button 202 of FIG. 2 and FIG. 3), a second input circuit 104 for outputting a signal in accordance with operation of a second button (reset button 203 of FIG. 2 and FIG. 3), a third input circuit 105 for outputting a signal in accordance with operation of a crown constituting operation means (crown 204 of FIG. 2 and FIG. 3), a control circuit 106 as control or controlling means comprised of a central processing unit (CPU) for carrying out a counting operation of the reference signal, a processing, or control of a total of the chronograph timepiece, a time indicating hand 109 for indicating current time, a first motor 108 for driving to rotate the time indicating hand 109, a first motor drive circuit 107 for driving the motor 108 in response to a signal from the control circuit 106, a first chronograph indicating hand (chronograph 1/10 second hand) 112 for indicating a measured time period by a 1/10 second unit, a second motor 111 for driving to rotate the first chronograph indicating hand 112, a second motor driver circuit 110 for driving the motor 111 in response to a signal from the control circuit 106, a second chronograph indicating hand (chronograph second/minute cooperation hand) 115 for cooperatively rotating a second hand and a minute hand for indicating the measured time period by second and minute, a third motor 114 for driving to rotate the second chronograph indicating hand 115, and a third motor driver circuit 113 for driving the motor 114 in response to a signal from the control circuit 106.

Figure 2:
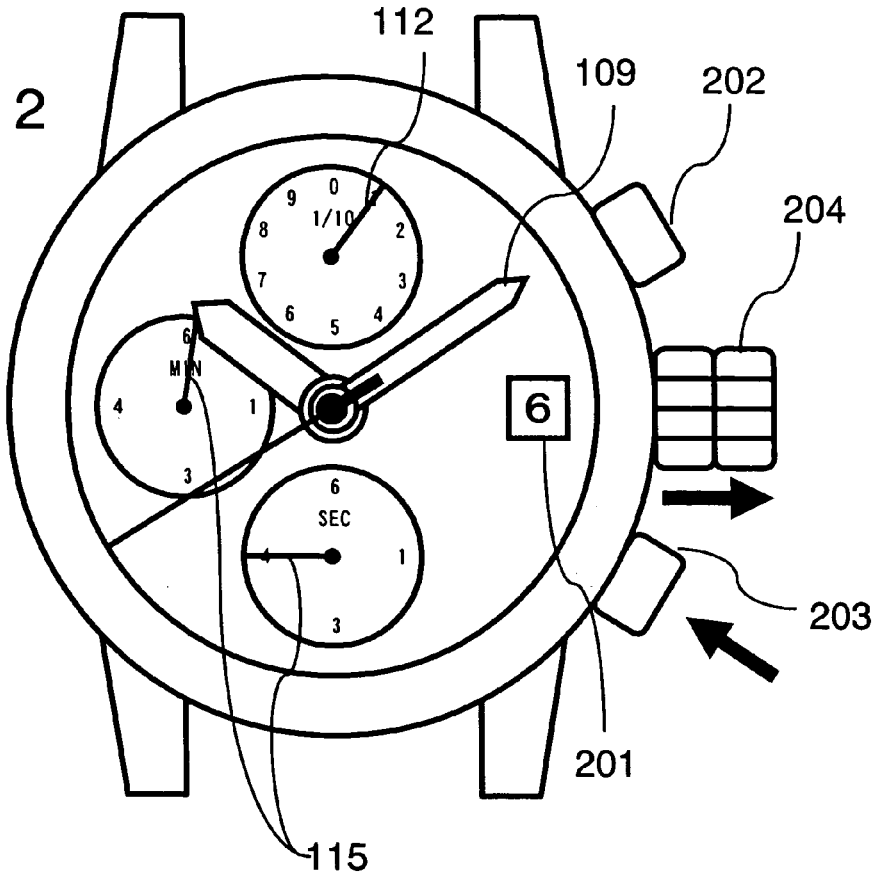
FIG. 2 is a front view of an outlook of the chronograph timepiece according to the first embodiment of the invention.
Figure 3:
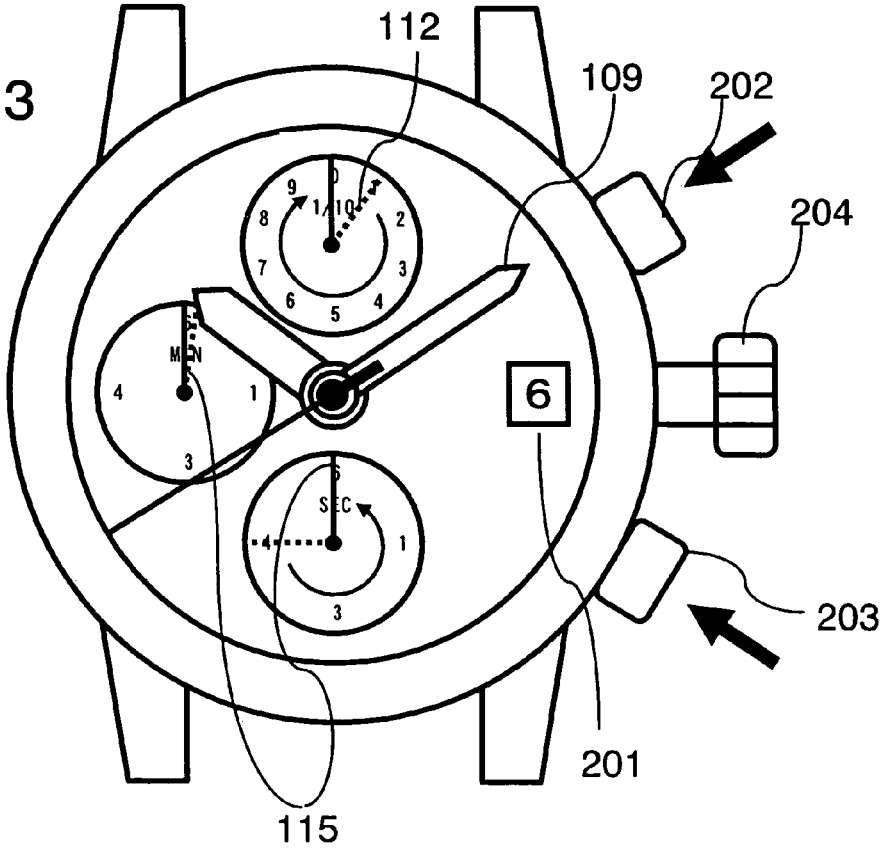
FIG. 3 is a front view of an outlook of the chronograph timepiece according to the first embodiment of the invention.

FIG. 2 and FIG. 3 are outline front views of the chronograph timepiece shown in FIG. 1 and portions which are the same as those of FIG. 1 are identified with the same reference numerals. Further, FIG. 2 is a view showing a time measuring state and FIG. 3 is a view showing a zero position returning operation state.

In FIG. 2 and FIG. 3, the chronograph timepiece is provided with the chronograph 1/10 second hand 112, the chronograph second/minute cooperation hand 115, a date indicating portion 201, the start button 202 for carrying out operation of starting to measure a time period and operation of stopping to measure the time period in the chronograph mode, the reset button 203 for carrying out resetting operation for returning the chronograph indicating hand to the zero position in a state of stopping to measure the time period in the chronograph mode, and the crown 204. Further, the reset button 203 is an operation button operated in shifting to the chronograph hand reset mode and is an operation button which is not provided with other function in shifting to the chronograph hand reset mode.

Figure 4:
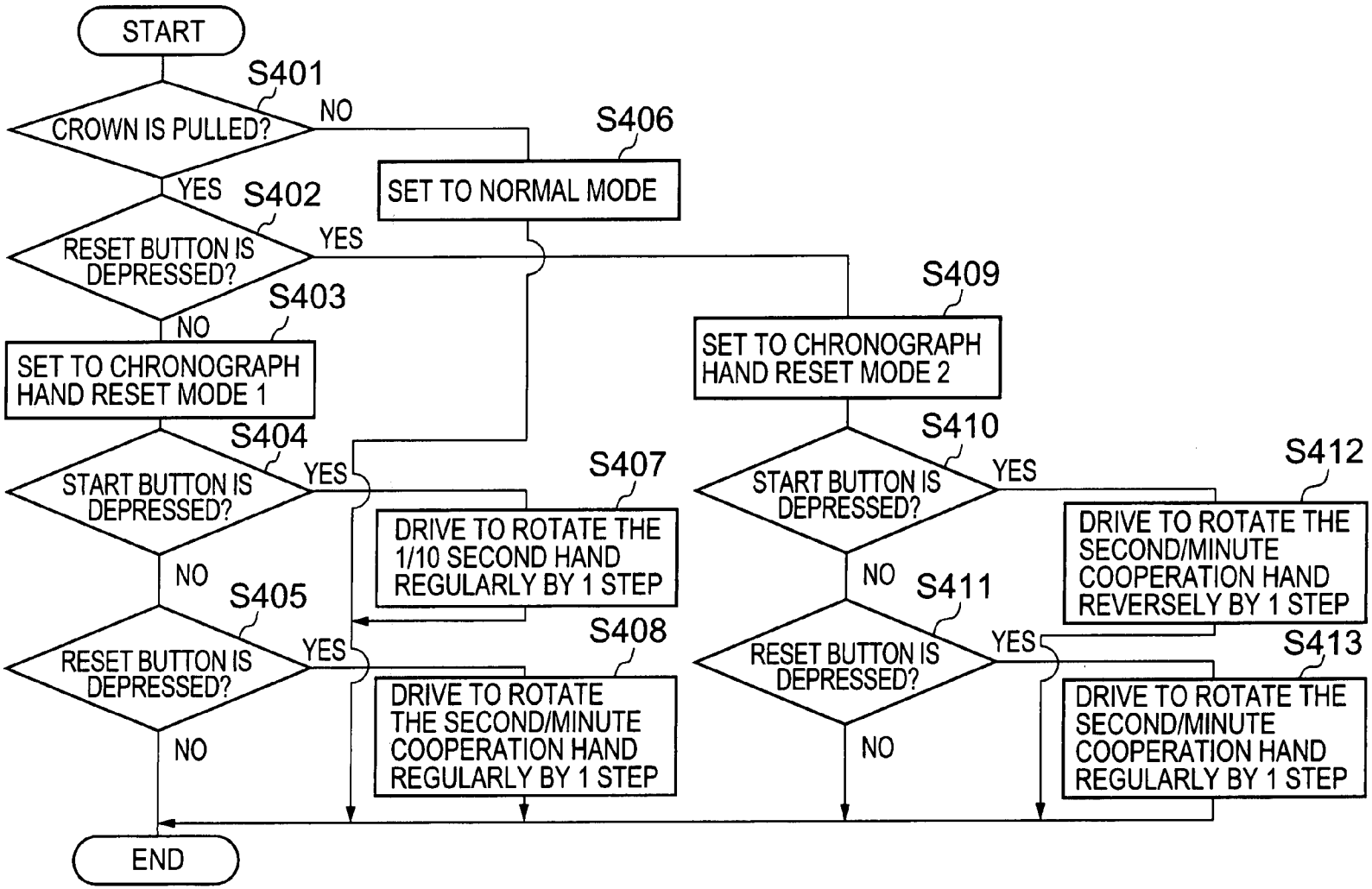
FIG. 4 is a flowchart showing operation of the chronograph timepiece according to the first embodiment of the invention.

FIG. 4 is a flowchart showing operation of the control circuit 106 according to the first embodiment of the invention.

A detailed explanation will be given of the operation of the first embodiment of the invention with reference to FIG. 1 through FIG. 4.

As an initial state, assume that the start button 202, the reset button 203 and the crown 204 are brought into an unoperated state.

First, explaining operation of indicating current time, the dividing circuit 102 divides a clock signal outputted from the oscillating circuit 101 and outputs a counting reference signal for constituting the reference signal for counting time.

The control circuit 106 generates time data indicating time by counting the counting reference signal. The time data indicating the current time is supplied to the motor driver circuit 107, the motor driver circuit 107 drives to rotate the motor 108 in response to the time data and the motor 108 drives to rotate the time indicating hand (for example, hour hand, minute hand, second hand) 109. Thereby, the current time is indicated by the time indicating hand 109.

Next, time measuring operation will be explained. When the start button 202 is operated to depress in a state in which the current time is counted and indicated, the time measurement start signal for instructing to start time measurement is outputted from the input circuit 103 to the control circuit 106. The control circuit 106 counts the counting reference signal in response to the time measurement start signal and measures an accumulated time period from starting to operate the start button 202. Time data indicating 1/10 second during the accumulated time period is supplied to the motor driver circuit 110, the motor driver circuit 110 drives to rotate the motor 111 in response to the time data indicating 1/10 second and the motor 111 drives to rotate the chronograph 1/10 second hand 112. Thereby, a time period by the 1/10 second unit is indicated by the chronograph 1/10 second hand 112.

At the same time, time data indicating second and minute during the accumulated time period is supplied to the motor driver circuit 113, the motor driver circuit 113 drives to rotate the motor 114 in response to the time data indicating second and minute and the motor 114 drives to rotate the chronograph second/minute cooperation hand 115. Thereby, a time period by the second/minute unit is indicated by the chronograph second/minute cooperation hand 115.

When a stopping operation to measure the time period is carried out by depressing the start button 202 in the time measuring state, the time measurement stop signal is outputted from the input circuit 103 to the control circuit 106 and the control circuit 106 finishes the time measuring operation. Thereby, as shown by FIG. 2, the chronograph 1/10 second hand 112 and the chronograph second/minute cooperation hand 115 are stopped in a state of indicating the measured time period.

Next, an explanation will be given of a resetting operation for returning the chronograph indicating hands 112 and 115 to zero positions.

In order to shift to a resetting operation in a state in which the chronograph 1/10 second hand 112 and the chronograph second/minute cooperation hand 115 are stopped as shown by FIG. 2, the shifting operation can be carried out by operating to pull the crown 204 in a state in which the reset button 203 is operated to depress. The resetting operation will be explained in details as follows.

First, the control circuit 106 determines whether the crown 204 is operated to pull (step S401), when it is determined that the crown 204 is not operated to pull, the chronograph timepiece is set to a normal mode for carrying out operation of counting and displaying time to carry out time counting and indicating operation.

When it is determined that the crown 204 is operated to pull at step S401, the control circuit 106 determines whether the reset button 203 has already been operated to press (step S402).

When it is determined that the reset button 203 has not been operated to depress yet at step S402, the control circuit 106 sets the chronograph timepiece to a chronograph hand reset mode 1 (step S403) and thereafter determines whether the start button 202 is operated to depress (step S404).

When it is determined that the start button 202 is operated to depress at step S404, the control circuit 106 drives to rotate the 1/10 second hand 112 regularly by 1 step (step S407).

When it is determined that the start button 202 is not operated to depress at step S404, the control circuit 106 determines whether the reset button 203 is operated to depress (step S405) and drives to rotate the second/minute cooperation hand 115 by 1 step when it is determined that the reset button 203 is operated to depress (step S408). When it is determined that the reset button 203 is not operated to depress at step S405, the control circuit 106 finishes the processing.

Meanwhile, when it is determined that the reset button 203 has already been operated to depress at step S402, the control circuit 106 sets the reset mode to the chronograph hand reset mode 2 (step S409) and thereafter determines whether the start button 202 is operated to depress (step S410).

When it is determined that the start button 202 is operated to depress at step S410, the control circuit 106 drives to rotate the second/minute cooperation hand 115 reversely by 1 step (step S412).

When it is determined that the start button 202 is not operated to depress at step S410, the control circuit 106 determines whether the reset button 203 is operated to depress (step S411) and drives to rotate the second/minute cooperation hand 115 regularly by 1 step when it is determined that the reset button 203 is operated to depress (step S413). When it is determined that the reset button 203 is not operated to depress at step S411, the control circuit 106 finishes the processing.

By repeating the above-described processing, the 1/10 second hand 112 and the second/minute cooperation hand 115 are returned to zero positions.

As described above, the chronograph timepiece according to the first embodiment of the invention is characterized in the chronograph timepiece including the crown 204, the start button 202 for starting and stopping to measure the time period and the reset button 203 for returning the chronograph hand to the zero position, and the control circuit 106 for shifting the resetting function of the start button 202 and the reset button 203 in resetting the plurality of chronograph hands 112 and 115 to the plurality of reset modes (chronograph hand reset mode 1, 2) having different resetting functions of the start button 202 and the reset button 203 in accordance with whether the reset button 203 has already been operated when the crown 204 is operated.

Further, in the case of shifting to the chronograph hand reset mode, an operation button which does not carry out other function at the time point (reset button 203 according to the embodiment) is constituted to operate and therefore, erroneous operation is not brought about in counting operation or the like by operating the operation button.

Further, in the respective reset modes, the chronograph hand and the rotational direction in resetting of the chronograph hand are made to correspond to the operation button, that is, in the respective chronograph hand reset modes 1 and 2, the functions in resetting of the respective operation buttons 202 and 203 are previously determined and therefore, resetting can be carried out by selecting corresponding ones of the chronograph hands 112 and 115 by the functions related to the respective operation buttons 202 and 203 and the constitution can be simplified.

Next, an explanation will be given of a chronograph timepiece according to a second embodiment of the invention.

Figure 5:
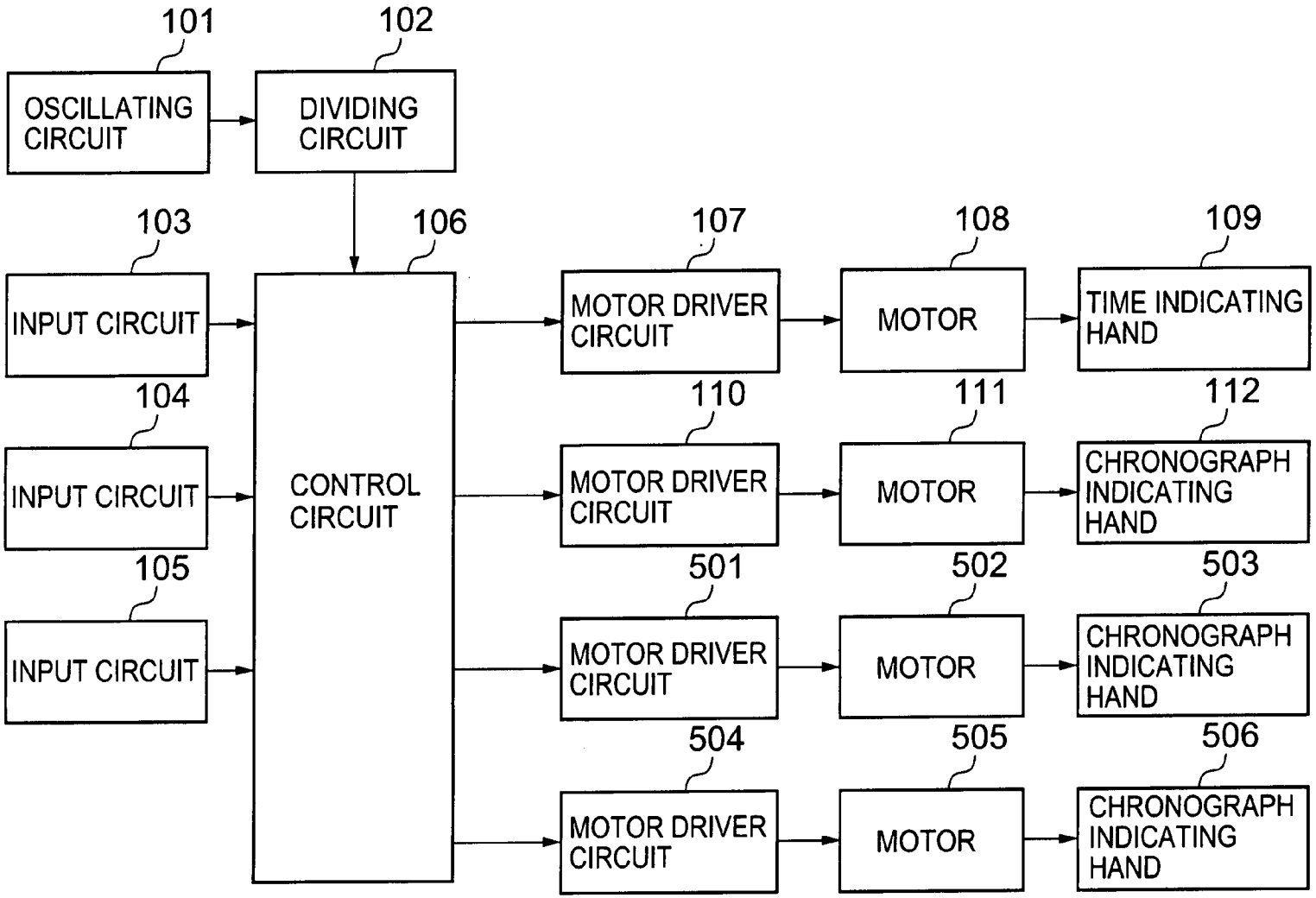
FIG. 5 is a block diagram of a chronograph timepiece according to a second embodiment of the invention.

FIG. 5 is a block diagram of a chronograph timepiece according to the second embodiment of the invention showing an example of an analog chronograph electronic timepiece having a time hand for indicating current time, a chronograph 1/10 second hand for indicating a measured time period by a 1/10 second unit, a chronograph second hand for indicating the measure time period by a 1 second unit and a chronograph minute hand for indicating the measured time period by a 1 minute unit and portions the same as those of FIG. 1 are attached with the same notations.

Further, similar to the first chronograph timepiece, the chronograph timepiece according to the second embodiment is provided with a date indicating portion (corresponding to the date indicating portion 201 of FIG. 2 and FIG. 3), a start button for operating to start and operating to stop to measure a time period (corresponding to the start button 202 of FIG. 2 and FIG. 3), a reset button for carrying out resetting operation for returning a chronograph indicating hand to a zero position (corresponding to the reset button 203 of FIG. 2 and FIG. 3) and a crown (corresponding to the crown 204 of FIG. 2 and FIG. 3) and for convenience of explanation, an explanation will be given by attaching notations the same as those of FIG. 2 and FIG. 3 to the start button, the reset button and the crown.

In FIG. 5, the chronograph timepiece includes the oscillating circuit 101 for generating the reference signal, the dividing circuit 102 for generating the counting reference signal for counting time by dividing the reference signal, the first input circuit 103 for outputting the time measurement start signal or the time measurement stop signal in accordance with the operation of the start button 202, the second input circuit 104 for outputting the signal in accordance with operation of the reset button 203, the third input circuit 105 for outputting the signal in accordance with operation of the crown 204, the control circuit 106 constituted by the central processing unit (CPU) for carrying out the counting operation of the counting reference signal, the processing, mentioned later, the control of the total of the chronograph timepiece, the time indicating hand 109 for indicating current time, the first motor 108 for driving to rotate the time indicating hand 109, the first motor driver circuit 107 for driving the motor 108 in response to the signal from the control circuit 106, the first chronograph indicating hand (1/10 second hand for chronograph) 112 for indicating the measured time period by the 1/10 second unit, the second motor 111 for driving to rotate the first chronograph indicating hand 112, the second motor driver circuit 110 for driving the motor 111 in response to the signal from the control circuit 106, a second chronograph indicating hand (chronograph second hand) 503 for indicating the measured time period by a 1 second unit, a third motor 502 for driving to rotate the second chronograph indicating hand 503, a third motor driver circuit 501 for driving the motor 502 in response to a signal from the control circuit 106, a third chronograph indicating hand (chronograph minute hand) 506 for indicating the measured time period by a 1 minute unit, a fourth motor 505 for driving to rotate the third chronograph indicating hand 506, and a fourth motor driver circuit 504 for driving the motor 505 in response to a signal from the control circuit 106.

Figure 6:
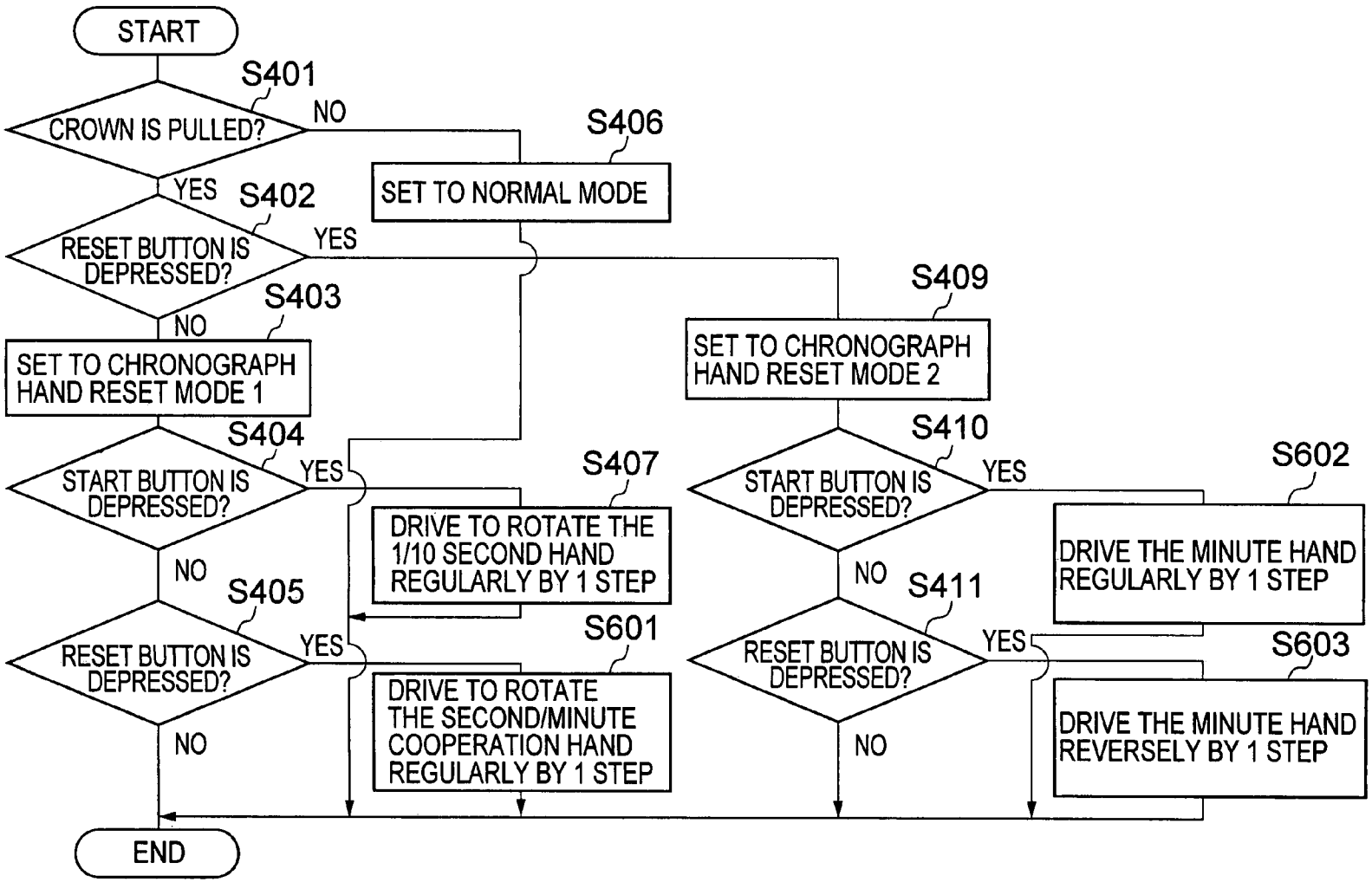
FIG. 6 is a flowchart showing operation of the chronograph timepiece according to the second embodiment of the invention.

FIG. 6 is a flowchart showing the operation of the control circuit 106 according to the second embodiment of the invention and portions for carrying out operations similar to those of FIG. 4 are identified with the same reference numerals.

Operation of the second embodiment of the invention will be explained in detail with reference to FIG. 5 to FIG. 6 as follows.

Assume that as an initial state, the start button 202, the reset button 203 and the crown 204 are brought into an unoperated state. Under the state, the operation is carried out similar to that in the first embodiment and current time is indicated by the time indicating hand 109.

In the time measuring operation, when the start button 202 is operated to depress in a state of counting and indicating the current time, the time measurement start signal for indicating to start to measure the time period is outputted from the input circuit 103 to the control circuit 106. The control circuit 106 counts the counting reference signal in response to the time measurement start signal to measure the accumulated time period form the time of starting to operate the start button 202.

The time data indicating 1/10 second in the accumulated time period is supplied to the motor driver circuit 110, the motor driver circuit 110 drives to rotate the motor 111 in response to the time data indicating 1/10 second and the motor 111 drives to rotate the chronograph 1/10 second hand 112. Thereby, the time period of the 1/10 second unit is indicated by the chronograph 1/10 second hand 112.

At the same time, the time data indicating second in the accumulated time period is supplied to the motor driver circuit 501, the motor driver circuit 501 drives to rotate the motor 502 in response to the time data indicating second and the motor 502 drives to rotate the chronograph secondhand 503. Thereby, the time period of the second unit is indicated by the chronograph second hand 503.

Further, time data indicating minute in the accumulated time period is supplied to the motor driver circuit 504, the motor driver circuit 504 drives to rotate the motor 505 in response to the time data indicating minute and the motor 505 drives to rotate the chronograph minute hand 506. Thereby, the time period by the minute unit is indicated by the chronograph minute hand 506.

When operation of stopping to measure the time period by operating to depress the start button 202 in the state of measuring the time period, the time measurement stop signal is outputted from the input circuit 103 to the control circuit 106 and the control circuit 106 finishes the operation of measuring the time period. Thereby, the chronograph 1/10 second hand 112, the chronograph second hand 503 and the chronograph minute hand 506 are stopped in the state of indicating the measured time period.

Next, an explanation will be given of a resetting operation for returning the chronograph indicating hands 112, 503 and 506 to zero positions.

In order to shift to the resetting operation in the state of stopping the chronograph 1/10 second hand 112, the chronograph second hand 503 and the chronograph minute hand 506, the shifting operation is carried out by operating to pull the crown 204 in the state of operating to depress the reset button 203. The resetting operation will be explained in details in reference to FIG. 6 as follows.

First, the control circuit 106 determines whether the crown 204 is operated to pull (step S401) and when it is determined that the crown 204 is not operated to pull, the chronograph timepiece is set to the normal mode for carrying out operation of counting and indicating time to carry out the counting and indicating operation.

When it is determined that the crown 204 is operated to pull at step S401, the control circuit 106 determines whether the reset button 203 has already been operated to depress (step S402).

When it is determined that the reset button 203 is not operated to depress at step S402, the control circuit 106 sets the reset mode to the chronograph hand reset mode 1 (step S403) and thereafter determines whether the start button 202 is operated to depress (step S404).

When it is determined that the start button 202 is operated to depress at step S404, the control circuit 106 drives to rotate the 1/10 second hand 112 regularly by 1 step (step S407).

When it is determined that the start button 202 is not operated to depress at step S404, the control circuit 106 determines whether the reset button 203 is operated to depress (step S405) and drives to rotate the second hand 503 regularly by 1 step when it is determined that the reset button 203 is operated to depress (step S601). When it is determined that the reset button 203 is not operated to depress at step S405, the control circuit 106 finishes the processing.

Meanwhile, when it is determined that the reset button 203 has already been operated to depress at step S402, the control circuit 106 sets the reset mode to the chronograph hand reset mode 2 (step S409) and thereafter determines whether the start button 202 is operated to depress (step S410).

When it is determined that the start button 202 is operated to depress at step S410, the control circuit 106 drives to rotate the minute hand 506 regularly by 1 step (step S602).

When it is determined that the start button 202 is not operated to depress at step S410, the control circuit 106 determines whether the reset button 203 is operated to depress (step S411) and drives the minute hand 506 reversely by 1 step when it is determined that the reset button 203 is operated to depress (step S603). When it is determined that the reset button 203 is not operated to depress at step S411, the control circuit 106 finishes the processing.

By repeating the above-described processing, the 1/10 second hand 112, the second hand 503 and the minute hand 506 are returned to the zero positions.

As described above, according to the chronograph timepiece according to the second embodiment of the invention, similar to the first embodiment, there is achieved an effect in which the plurality of chronograph hands can swiftly be returned to the zero positions or the like even when the chronograph hands are stopped at any positions in the chronograph hand reset mode.

According to the chronograph timepiece of the invention, in the chronograph hand reset mode, even when the chronograph hand is stopped at any position, the chronograph hand can swiftly be returned to the zero position.

Further, in shifting to the chronograph hand reset mode, the reset button which does not carry out other function is constituted to use at the time point and therefore, erroneous operation is not brought about in counting operation or the like by using the reset button.

Further, the function of the operation button and the chronograph hand in resetting are made to correspond to each other and therefore, resetting can be carried out by selecting the chronograph hand by the simple constitution.

What is claimed is:

1. A chronograph timepiece comprising:

a crown for undergoing operation;

a start button operable to start and stop measurement of a time period in a chronograph mode using at least one chronograph hand;

a reset button operable to reset the chronograph hand to a zero position; and control means for controlling operation of the start button and the reset button in a plurality of reset modes to return the chronograph hand to the zero position in accordance with whether the reset button has already been operated when the crown is operated.

2. A chronograph timepiece according to claim 1; wherein the control means controls the operation of the start button and the reset button in the reset modes so that the chronograph hand undergoes rotation in a preselected direction of rotation.

3. A chronograph timepiece according to claim 1; wherein the chronograph hand comprises a chronograph 1/10 second hand and a chronograph second/minute cooperation hand; and wherein the control means controls operation of the start button to rotate the chronograph 1/10 second hand in a first direction of rotation and controls operation of the reset button to rotate the chronograph second/minute cooperation hand in the first direction of rotation when the reset button has not been operated yet when the crown is operated.

4. A chronograph timepiece according to claim 1; wherein the at least one chronograph hand comprises a chronograph second/minute cooperation hand; and wherein the control means controls operation of the start button to rotate the chronograph second/minute cooperation hand in a first direction of rotation and controls operation of the reset button to rotate the chronograph second/minute cooperation hand in a second direction of rotation opposite to the first direction of rotation when the reset button has already been operated when the crown is operated.

5. A chronograph timepiece according to claim 1; wherein the at least one chronograph hand comprises a chronograph 1/10 second hand and a chronograph second hand; and wherein the control means controls operation of the start button to rotate the chronograph 1/10 second hand in a first direction of rotation and controls operation of the reset button to rotate the chronograph second hand in the first direction of rotation when the reset button has not been operated yet when the crown is operated.

6. A chronograph timepiece according to claim 1; wherein the at least one chronograph hand comprises a chronograph minute hand; and wherein the control means controls operation of the start button to rotate the chronograph minute hand in a first direction of rotation and controls the reset button to rotate the chronograph minute hand in a second direction of rotation opposite the first direction of rotation when the reset button has already been operated when the crown is operated.

7. A chronograph timepiece according to claim 2; wherein the at least one chronograph hand comprises a chronograph second/minute cooperation hand; and wherein the control means controls operation of the start button to chronograph second/minute cooperation hand in a first direction of rotation and controls operation of the reset button to rotate the chronograph second/minute cooperation hand in a second direction of rotation opposite to the first direction of rotation when the reset button has already been operated when the crown is operated.

8. A chronograph timepiece comprising:

a start button operable to start and stop measurement of a time period in a chronograph mode using at least one chronograph hand;

a reset button operable to reset the chronograph hand to a zero position;

operation means for undergoing a first operation in which the start button is operable to start and stop measurement of a time period in the chronograph mode and for undergoing a second operation in which the start button and the reset button are operable to reset the chronograph hand; and a control circuit for controlling operation of the start button and the reset button in a plurality of reset modes to return the at least one chronograph hand to the zero position in accordance with whether the reset button has already been operated when the operation means undergoes the second operation.

9. A chronograph timepiece according to claim 8; wherein the operation means comprises a crown movable to positions corresponding to the respective first and second operations.

10. A chronograph timepiece according to claim 8; wherein the at least one chronograph hand comprises a chronograph 1/10 second hand and a chronograph second/minute cooperation hand; and wherein the control means controls operation of the start button to rotate the chronograph 1/10 secondhand in a first direction of rotation and controls operation of the reset button to rotate the chronograph second/minute cooperation hand in the first direction of rotation when the reset button has not been operated yet when the operation means undergoes the second operation.

11. A chronograph timepiece according to claim 8; wherein the at least one chronograph hand comprises a chronograph second/minute cooperation hand; and wherein the control means controls operation of the start button to rotate the chronograph second/minute cooperation hand in a first direction of rotation and controls operation of the reset button to rotate the chronograph second/minute cooperation hand in a second direction of rotation opposite to the first direction of rotation when the reset button has already been operated when the operation means undergoes the second operation.

12. A chronograph timepiece according to claim 8; wherein the at least one chronograph hand comprises a chronograph 1/10 second hand and a chronograph second hand;

and wherein the control means controls operation of the start button to rotate the chronograph 1/10 second hand in a first direction of rotation and controls operation of the reset button to rotate the chronograph second hand in the first direction of rotation when the reset button has not been operated yet when the operation means undergoes the second operation.

13. A chronograph timepiece according to claim 8; wherein the at least one chronograph hand comprises a chronograph minute hand; and wherein the control means controls operation of the start button to rotate the chronograph minute hand in a first direction of rotation and controls the reset button to rotate the chronograph minute hand in a second direction of rotation opposite the first direction of rotation when the reset button has already been operated when the operation means undergoes the second operation.

14. A chronograph timepiece comprising:

a first button operable to start and stop measurement of a time period in a chronograph mode using at least one chronograph hand;

a second button operable to reset the chronograph hand after measurement of a time period in the chronograph mode;

a crown movable between a first position, in which the first and second buttons are operable to reset the chronograph hand, and a second position, in which the first button is operable to start and stop measurement of a time period in the chronograph mode; and a control circuit for controlling operation of the first and second buttons between first and second reset modes of the chronograph timepiece to return the chronograph hand to the zero position when the crown is in the first position.

15. A chronograph timepiece according to claim 14; wherein the at least one chronograph hand comprises a 1/10 second hand and a second/minute cooperation hand; and wherein in the first reset mode, the control circuit controls operation of the first and second buttons so that the 1/10 second hand is rotated in a first direction of rotation when the first button is operated and the second button is not operated and so that the second/minute cooperation hand is rotated in the first direction of rotation when the second button is operated and the first button is not operated.

16. A chronograph timepiece according to claim 15; wherein in the second reset mode, the control circuit controls operation of the first and second buttons so that the second/minute cooperation hand is rotated in a second direction of rotation opposite to the first direction of rotation when the first button is operated and so that the second/minute cooperation hand is rotated in the first direction of rotation when the second button is operated.

17. A chronograph timepiece according to claim 14; wherein the at least one chronograph hand comprises a 1/10 second hand, a second/minute cooperation hand, and a minute hand; and wherein in the first reset mode, the control circuit controls operation of the first and second buttons so that the 1/10 second hand is rotated in a first direction of rotation when the first button is operated and the second button is not operated and so that the second/minute cooperation hand is rotated in the first direction of rotation when the second button is operated and the first button is not operated.

18. A chronograph timepiece according to claim 17; wherein in the second reset mode, the control circuit controls operation of the first and second buttons so that the minute hand is rotated in a second direction of rotation opposite to the first direction of rotation when the first button is operated and so that the minute hand is rotated in the second direction of rotation when the second button is operated.

19. A chronograph timepiece according to claim 14; wherein the control circuit controls the first and second buttons to achieve the first reset mode of the chronograph timepiece when the second button is not initially operated after the crown is moved to the first position.

20. A chronograph timepiece according to claim 14; wherein the control circuit controls the first and second buttons to achieve the second reset mode of the chronograph timepiece when the second button is initially operated after the crown is moved to the first position.

* * * * *